US010634137B2

(12) United States Patent
Fraser et al.

(10) Patent No.: US 10,634,137 B2
(45) Date of Patent: Apr. 28, 2020

(54) SUCTION HEADER ARRANGEMENT FOR OIL MANAGEMENT IN MULTIPLE-COMPRESSOR SYSTEMS

(71) Applicants: Bruce A. Fraser, Manlius, NY (US); Ronald J. Duppert, Fayetteville, NY (US); Wayne P. Beagle, Chittenango, NY (US)

(72) Inventors: Bruce A. Fraser, Manlius, NY (US); Ronald J. Duppert, Fayetteville, NY (US); Wayne P. Beagle, Chittenango, NY (US)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 857 days.

(21) Appl. No.: 13/932,540

(22) Filed: Jul. 1, 2013

(65) Prior Publication Data

US 2014/0056725 A1 Feb. 27, 2014

Related U.S. Application Data

(60) Provisional application No. 61/677,742, filed on Jul. 31, 2012, provisional application No. 61/677,756,
(Continued)

(51) Int. Cl.
*F04C 15/00* (2006.01)
*F04C 29/12* (2006.01)
(Continued)

(52) U.S. Cl.
CPC ..... *F04C 15/0088* (2013.01); *F04C 18/0215* (2013.01); *F04C 23/001* (2013.01);
(Continued)

(58) Field of Classification Search
CPC .. F04C 15/0088; F04C 18/0215; F04C 29/02; F04C 29/026; F04C 2240/806; C04C 23/008
(Continued)

(56) References Cited

U.S. PATENT DOCUMENTS 3,360,958 A 1/1968 Miner
3,386,262 A 6/1968 Hackbart et al.
(Continued)

FOREIGN PATENT DOCUMENTS

EP 1 120 611 A1 8/2001
EP 1120611 A1 * 8/2001 ..... F04B 39/16
(Continued)

OTHER PUBLICATIONS

McGraw-Hill Dictionary of Engineering—Definition of "Branch".*
(Continued)

*Primary Examiner* — Devon C Kramer
*Assistant Examiner* — Christopher J Brunjes
(74) *Attorney, Agent, or Firm* — Reinhart Boerner Van Deuren P.C.

(57) ABSTRACT

A refrigeration system with two or more compressors configured to compress a flow of refrigerant with oil entrained therein. A suction flow piping arrangement is configured to supply a flow of refrigerant and oil to the two or more compressors. The suction flow piping arrangement has a suction header configured to carry the flow of refrigerant and oil, and a primary compressor supply conduit connected to the suction header. The primary compressor supply conduit supplies refrigerant and oil to a first compressor of the two or more compressors. A secondary compressor supply conduit branches off from the suction header. The secondary compressor supply conduit supplies refrigerant to a second compressor of the two or more compressors. The primary
(Continued)

compressor supply conduit is configured to supply more oil to the first compressor than the secondary compressor supply conduit supplies to the second compressor.

34 Claims, 11 Drawing Sheets

Related U.S. Application Data filed on Jul. 31, 2012, provisional application No. 61/793,988, filed on Mar. 15, 2013.

(51) Int. Cl.

| | |
|---|---|
| ***F04C 28/02*** | (2006.01) |
| ***F04C 29/02*** | (2006.01) |
| ***F25B 31/00*** | (2006.01) |
| ***F04C 18/02*** | (2006.01) |
| ***F04C 23/00*** | (2006.01) |

(52) U.S. Cl.
CPC ..... *F04C 28/02* (2013.01); *F04C 29/028* (2013.01); *F04C 29/12* (2013.01); *F25B 31/004* (2013.01); *F04C 23/008* (2013.01); *F04C 29/026* (2013.01); *F04C 2240/806* (2013.01); *F25B 2400/075* (2013.01)

(58) Field of Classification Search
USPC ..... 417/288, 410.5
See application file for complete search history.

(56) References Cited

U.S. PATENT DOCUMENTS

| | | | | |
|---|---|---|---|---|
| 3,581,519 | A | 6/1971 | Garrett et al. | |
| 4,729,228 | A | 3/1988 | Johnsen | |
| 5,901,559 | A | 5/1999 | Westermeyer et al. | |
| 6,599,109 | B2 | 7/2003 | Zamudio et al. | |
| 6,736,607 | B2 | 5/2004 | Ginies et al. | |
| 7,316,291 | B2 | 1/2008 | Thomsen et al. | |
| 7,421,850 | B2 | 9/2008 | Street et al. | |
| 7,721,757 | B2 | 5/2010 | Ginies et al. | |
| 8,079,830 | B2 | 12/2011 | Süss et al. | |
| 8,337,183 | B2 | 12/2012 | Milliff et al. | |
| 2001/0026766 | A1 | 10/2001 | Terai et al. | |
| 2005/0229627 | A1* | 10/2005 | De Bernardi | F25B 31/002 62/468 |
| 2006/0059929 | A1 | 3/2006 | Sakitani et al. | |
| 2007/0074534 | A1 | 4/2007 | Sato | |
| 2008/0229627 | A1* | 9/2008 | Calderwood | E02F 5/32 37/456 |
| 2009/0035168 | A1 | 2/2009 | Ginies et al. | |
| 2009/0041602 | A1 | 2/2009 | Ginies et al. | |
| 2009/0081062 | A1 | 3/2009 | Upadhye et al. | |
| 2010/0186433 | A1 | 7/2010 | Galante et al. | |
| 2010/0186439 | A1 | 7/2010 | Ogata et al. | |
| 2011/0081254 | A1* | 4/2011 | Hafkemeyer | F04B 39/0207 417/13 |
| 2012/0017636 | A1 | 1/2012 | Wade et al. | |

FOREIGN PATENT DOCUMENTS

| | | | |
|---|---|---|---|
| JP | 04287880 | A | 10/1992 |
| JP | 05071811 | A | 3/1993 |
| JP | H05272477 | A | 10/1993 |
| JP | 07035045 | A | 2/1995 |
| JP | H0829018 | A | 2/1996 |
| JP | H0861809 | A | 3/1996 |
| JP | 08128764 | A | 5/1996 |
| JP | 2605498 | B2 * | 4/1997 |
| JP | 2605498 | B2 * | 4/1997 |
| JP | 2001132645 | A | 5/2001 |
| JP | 2005076515 | A | 3/2005 |
| KR | 1020050065258 | A | 6/2005 |
| WO | WO 97/16647 | A1 | 5/1997 |
| WO | WO 2005/103492 | A1 | 11/2005 |
| WO | WO 2008081093 | A2 | 7/2008 |

OTHER PUBLICATIONS

U.S. Appl. No. 13/950,488, Bruce A. Fraser et al., filed Jul. 25, 2013.

U.S. Appl. No. 13/950,467, Bruce A. Fraser et al., filed Jul. 25, 2013.

* cited by examiner

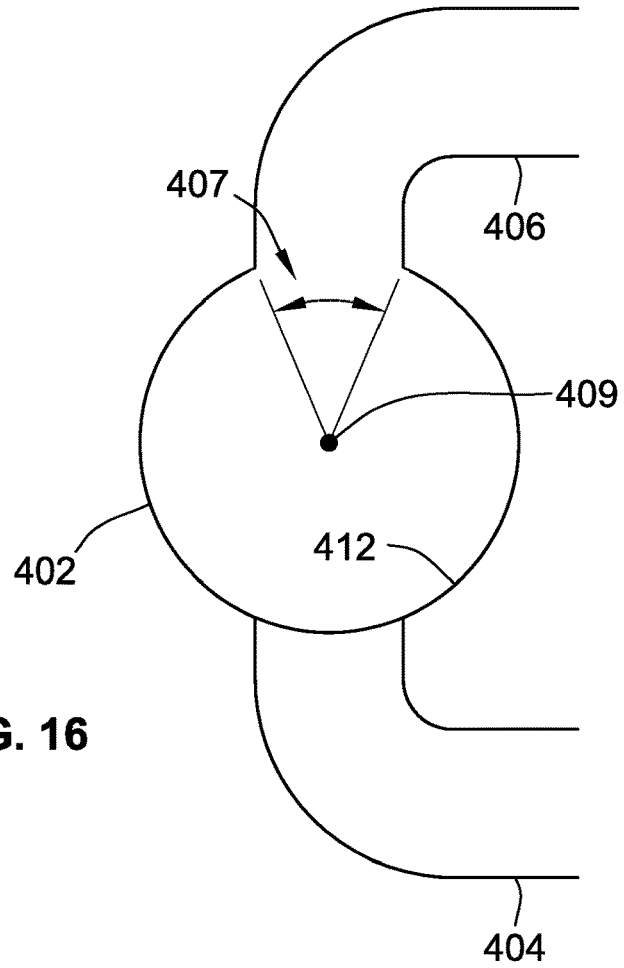
FIG. 16
FIG. 17
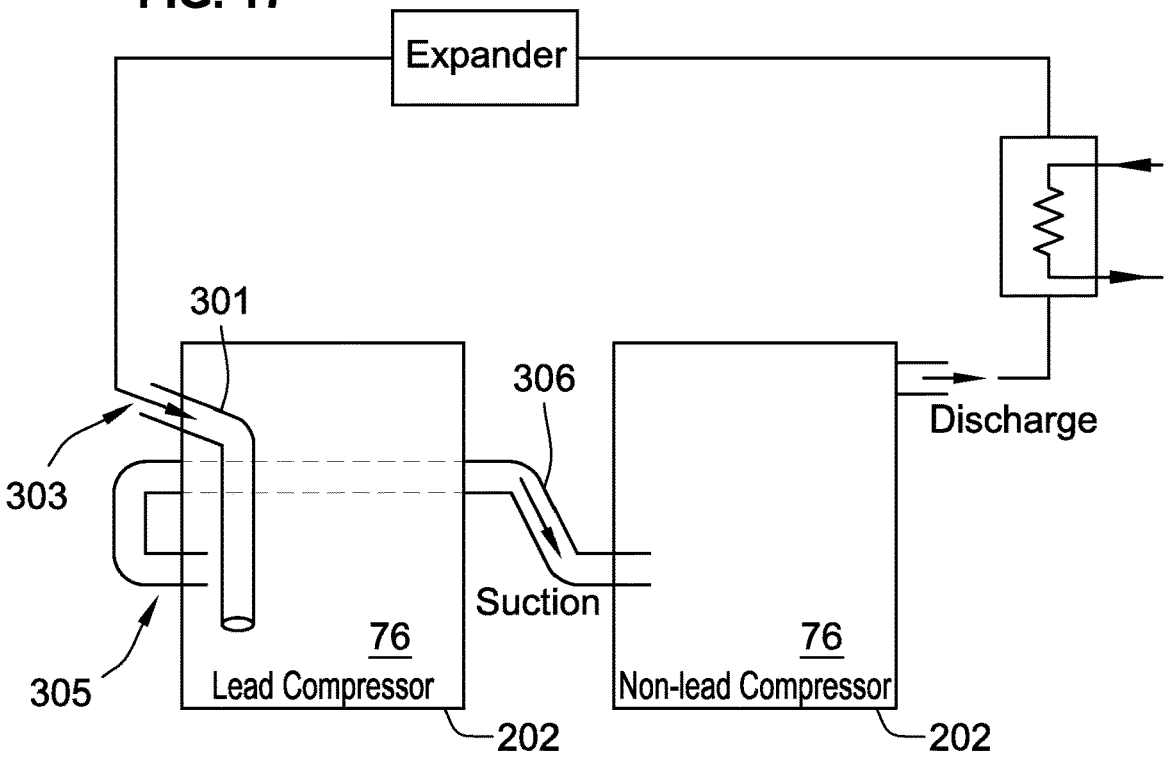

SUCTION HEADER ARRANGEMENT FOR OIL MANAGEMENT IN MULTIPLE-COMPRESSOR SYSTEMS

CROSS-REFERENCE TO RELATED PATENT APPLICATIONS

This patent application claims the benefit of U.S. Provisional Patent Applications Nos. 61/677,742, filed Jul. 31, 2012, and 61/677,756, filed Jul. 31, 2012, the entire teachings and disclosure of which are incorporated herein by reference thereto.

FIELD OF THE INVENTION

This invention generally relates to multi-compressor refrigeration systems.

BACKGROUND OF THE INVENTION

A particular example of the state of the art with respect to suction gas distribution in a parallel compressor assembly is represented by WIPO patent publication WO2008/081093 (Device For Suction Gas Distribution In A Parallel Compressor Assembly, And Parallel Compressor Assembly), which shows a distribution device for suction gas in systems with two or more compressors, the teachings and disclosure of which is incorporated in its entirety herein by reference thereto. A particular example of oil management in systems having multiple compressors is disclosed in U.S. Pat. No. 4,729,228 (Suction Line Flow Stream Separator For Parallel Compressor Arrangements), the teachings and disclosure of which is incorporated in its entirety herein by reference thereto.

Embodiments of the invention described herein represent an advancement over the current state of the art. These and other advantages of the invention, as well as additional inventive features, will be apparent from the description of the invention provided herein.

BRIEF SUMMARY OF THE INVENTION

In one aspect, embodiments of the invention provide a refrigeration system that includes two or more compressors configured to compress a flow of refrigerant. The flow of refrigerant is accompanied by a flow of oil therewith. A suction flow piping arrangement is configured to supply a flow of refrigerant and oil to the two or more compressors. The suction flow piping arrangement includes a suction header configured to carry the flow of refrigerant and oil. A primary compressor supply conduit is connected to the suction header. The primary compressor supply conduit is configured to supply refrigerant and oil to a first compressor of the two or more compressors. A secondary compressor supply conduit is connected to the suction header. The secondary compressor supply conduit is configured to supply refrigerant to a second compressor of the two or more compressors. The primary compressor supply conduit is configured to supply more oil to the first compressor than the secondary compressor supply conduit supplies to the second compressor.

In a particular embodiment, the primary compressor supply conduit has an inlet port connected to the suction header and the secondary compressor supply conduit has an inlet port connected to the header. In this embodiment, the inlet port of the primary compressor supply conduit is vertically below the inlet port of the secondary compressor supply conduit. The inlet port of the primary compressor supply conduit may be arranged to form a gravitational drain as an opening at a vertical bottom location of the suction header.

In a further embodiment, the suction header has a funnel portion which reduces a diameter of the suction header and connects a larger-diameter area of the suction header with a smaller-diameter area of the inlet port for the primary compressor supply conduit.

In certain embodiments, the suction flow piping arrangement includes a return conduit upstream of the suction header and connected to an inlet of the suction header. The suction header has a distal end farthest away from the inlet. The inlet port of the primary compressor supply conduit is disposed closer to the distal end than the inlet port of the secondary compressor supply conduit.

Furthermore, the suction header has an annular wall having a circumference of 360 degrees surrounding a central passage, wherein the secondary compressor supply conduit intersects the annular wall at a side or upper portion of the annular wall such that an arc of the intersection is less than 120 degrees, wherein, during operation, oil flows along an internal surface of the annular wall, and a majority of oil bypasses the inlet port of the secondary compressor supply conduit. Preferably, this arc of the intersection ranges from 60 to 100 degrees.

In an alternate embodiment of the invention, the suction header has an annular wall surrounding a central passage, but the secondary compressor supply conduit intersects the annular wall and extends internally past the annular into the central passage via an extension segment. During operation, oil flows along an internal surface of the annular wall, and a majority of the oil bypasses the inlet port of the secondary compressor supply conduit.

In a particular embodiment, the inlet port of the primary compressor supply conduit is vertically below the inlet port of the secondary compressor supply conduit by at least one centimeter. In a further embodiment, the primary compressor supply conduit a first flow area and a flow path thereof, and the secondary compressor supply conduit defines a second flow area and a flow path thereof. The first flow path creates a pressure drop to a first compressor oil sump and the second flow path creates a pressure drop to a second compressor oil sump such that a pressure in the first compressor oil sump is from 0.1 psi to 2.0 psi greater than a pressure in the second compressor oil sump. In a more particular embodiment, the primary compressor supply conduit defines a first minimum flow area along a flow path thereof and the secondary compressor supply conduit defines a second minimum flow area along a flow path thereof. The suction header comprises a minimum flow area that is at least 1.5 times as large as the first and second minimum flow areas combined.

In at least one embodiment, the suction flow piping arrangement includes a return conduit upstream of the suction header and connected to an inlet of the suction header. The return conduit has a minimum flow area. The minimum flow area of the suction header is at least 1.4 times larger than the minimum flow area of the return conduit. The suction header has a decreased flow velocity during operation for reduced splashing of oil carried along the inner wall of the return conduit upon entry into the suction header.

The refrigeration system may include an expansion funnel segment expanding the cross-sectional flow area from the return conduit to the suction header. The refrigeration system may have a horizontal suction header, or one that is pitched at an angle between zero and five degrees from horizontal. In embodiments of the invention, the primary and secondary compressor supply conduits each have inner diameters between 25% and 75% of an inner diameter of the suction header. In more particular embodiments, the primary and secondary compressor supply conduits each have inner diameters between 45% and 55% of an inner diameter of the suction header. In certain embodiments, the primary compressor supply conduit is greater than an inner diameter of the secondary compressor supply conduit.

The refrigeration system of claim 1, wherein the secondary compressor supply conduit is configured to restrict a flow therethrough such that the flow through the secondary compressor supply conduit is less than the flow through the primary compressor supply conduit. The primary compressor supply conduit may be configured to branch off from the suction header in a vertically downward direction, while the secondary compressor supply conduit branches off from the suction header in a vertically upward direction. Alternatively, the primary compressor supply conduit may be configured to branch off from the suction header in a vertically downward direction, while the secondary compressor supply conduit branches off from the suction header in a substantially horizontal direction.

In an alternate embodiment, the primary compressor supply conduit may be configured to branch off from the suction header in a vertically downward direction, while the secondary compressor supply conduit also branches off from the suction header in a downward direction but also protrudes substantially inward into the suction header. In a more particular embodiment, the secondary compressor supply conduit protrudes into the suction header a distance equaling from 25% to 75% of the suction header inner diameter.

A flow pressure within the primary compressor supply conduit is greater than a pressure within the secondary compressor supply conduit. In a particular example, the pressure within the primary compressor supply conduit is from 0.3 psi to 1.5 psi greater than the pressure with the secondary compressor supply conduit.

In further embodiments, the refrigeration system includes a tertiary compressor supply conduit connected to the suction header, and configured to supply refrigerant and oil to a third compressor, wherein the primary compressor supply conduit is configured to supply more oil to the first compressor than the tertiary compressor supply conduit supplies to the third compressor.

In an exemplary embodiment, an oil sump pressure in the first compressor is between zero and 1.0 psi greater than an oil sump pressure in the second compressor, and wherein an oil sump pressure in the second compressor is approximately equal to the oil sump pressure in the third compressor.

In one embodiment, the flow of refrigerant and oil through the suction header reaches the primary compressor supply conduit before it reaches the secondary compressor supply conduit. In an alternate embodiment, the flow of refrigerant and oil through the suction header reaches the secondary compressor supply conduit before it reaches the primary compressor supply conduit.

In a particular embodiment, each of the two or more compressors include an opening in its compressor housing, each opening located proximate an oil sump of its respective compressor, the openings being connected via an oil sump connection, and wherein, during operation, a differential pressure exists with a higher pressure in the primary compressor to cause distribution of excess oil returned to the primary compressor to the secondary compressor through the oil sump connection.

In another aspect, embodiments of the invention provide a method of distributing oil in a multiple-compressor system. The method includes the steps of returning flow of oil and refrigerant to a suction header, and directing a flow of oil from the suction header to two or more compressors. A majority of the oil is directed to a lead compressor, and oil is distributed from the lead compressor to one or more non-lead compressors. Directing a flow of oil from the suction header to two or more compressors may include directing oil to the lead compressor via a primary compressor supply conduit, and directing oil to the one or more non-lead compressors via a secondary compressor supply conduit. The flow pressure in the primary compressor supply conduit is greater than the flow pressure in the secondary compressor supply conduit.

In a particular embodiment of the invention, the primary compressor supply conduit has an inlet positioned to form a gravitational drain at a vertical bottom location of the suction header. The secondary compressor supply conduit may include a restriction to reduce the flow of oil to its respective compressor. In particular embodiments, the restriction in the secondary compressor supply conduit is configured to create reduced suction pressure at the inlet port of its respective compressor.

The aforementioned method may also include directing oil to the lead compressor via a primary compressor supply conduit having an inlet positioned to form a gravitational drain at a vertical bottom location of the suction header. In certain embodiments, the primary compressor supply conduit branches off from the suction header in one of a downwardly vertical, downwardly angled, or horizontal direction.

The aforementioned method may further include directing oil to the one or more non-lead compressors via a secondary compressor supply conduit having an inlet positioned at a higher elevation than the inlet of the primary compressor supply conduit. In certain embodiments, the secondary compressor supply conduit branches off from the suction header in either a horizontal, upwardly vertical, or upwardly angled direction. In more particular embodiments, the secondary compressor supply conduit may branch off from the suction header in any direction, while protruding into the suction header a distance equaling from 25% to 75% of the suction header inner diameter. Additionally, the method may include returning a flow of oil and refrigerant to a suction header that is disposed horizontally, or alternatively, to a suction header that is pitched at an angle between zero and five degrees from horizontal.

Further, it is contemplated that embodiments of the invention include multi-compressor systems in which the individual compressors have different capacities. The use of a plurality of compressors in a refrigeration system, where the individual compressors have different volume indexes is disclosed in U.S. Patent Publication No. 2010/0186433 (Scroll Compressors With Different Volume Indexes and Systems and Methods For Same), filed on Jan. 22, 2010, the teachings and disclosure of which is incorporated in its entirety herein by reference thereto.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings:

FIG. 16 is a cross-sectional view of the suction header and compressor supply conduit, according to an embodiment of the invention; and FIG. 17 is a cross-sectional view of a compressor system with an internal vertical header, in accordance with an embodiment of the invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

The following detailed description describes embodiments of the invention as applied in a multi-compressor refrigeration system. However, one of ordinary skill in the art will recognize that the invention is not necessarily limited to refrigeration systems. Embodiments of the invention may also find use in other systems where multiple compressors are used to supply a flow of compressed gas.

Figure 1:
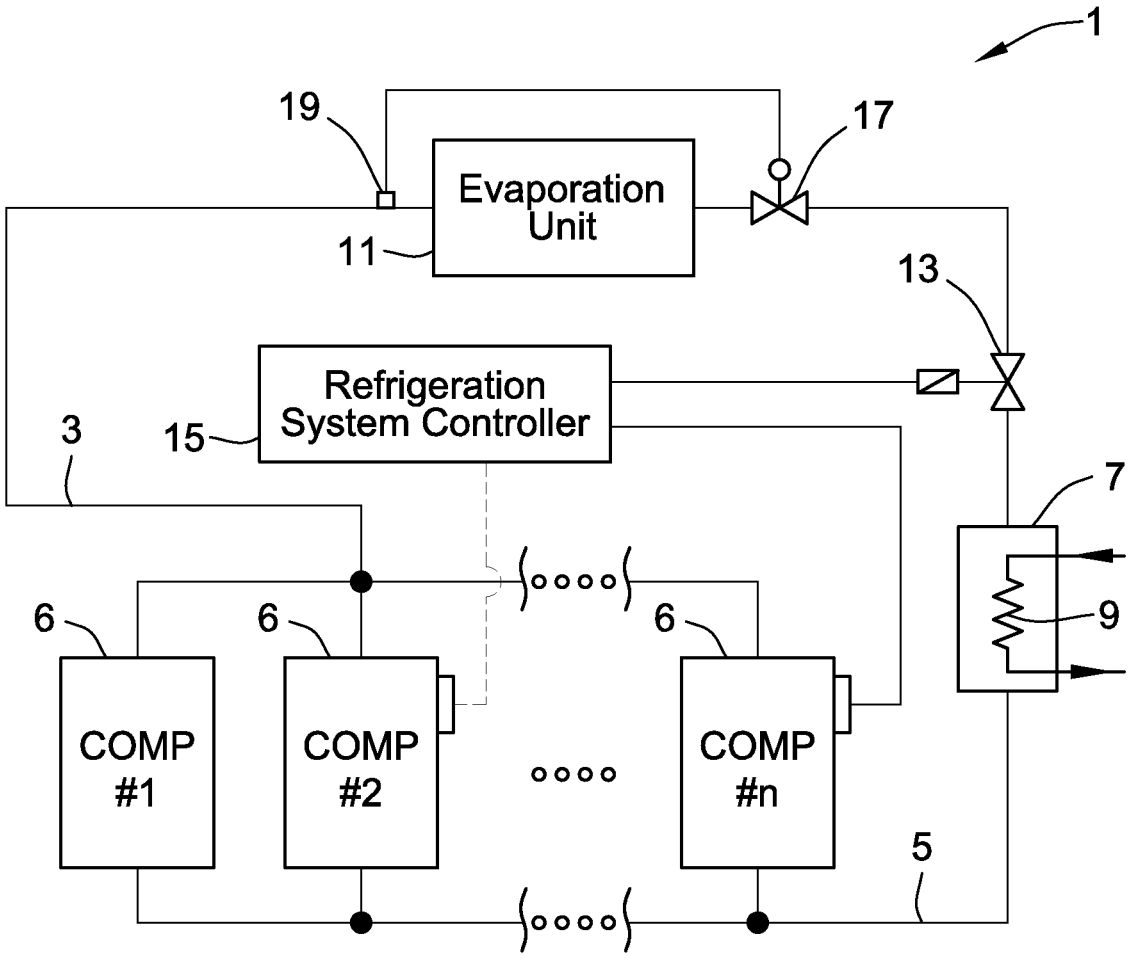
FIG. 1 is a block diagram of a multi-compressor refrigeration system, constructed in accordance with an embodiment of the invention.

FIG. 1 provides a schematic illustration of an exemplary multiple-compressor refrigeration system 1 having N compressors 6. The N compressors 6 of refrigeration system 1 are connected in a parallel circuit having inlet flow line 3 that supplies a flow of refrigerant to the N compressors 6, and outlet flow line 5 that carries compressed refrigerant away from the N compressors 6. In certain embodiments, the flow of refrigerant also includes a flow of oil, for example, along an interior surface of a suction header, and also entrained within the flow of refrigerant, the oil used to lubricate moving parts of the compressor 6. As shown, the outlet flow line 5 supplies a condenser 7. In a particular embodiment, the condenser 7 includes a fluid flow heat exchanger 9 (e.g. air or a liquid coolant) which provides a flow across the condenser 7 to cool and thereby condense the compressed, high-pressure refrigerant.

An evaporation unit 11 to provide cooling is also arranged in fluid series downstream of the condenser 7. In an alternate embodiment, the condenser 7 may feed multiple evaporation units arranged in parallel. In the embodiment of FIG. 1, the evaporation unit 11 includes an shut off liquid valve 13, which, in some embodiments, is controlled by the refrigeration system controller 15 to allow for operation of the evaporation unit 11 to produce cooling when necessitated by a demand load on the refrigeration system 1, or to preclude operation of the evaporation unit 11 when there is no such demand. The refrigeration system controller 15 may also be directly connected to one or more of the N compressors 6. The evaporation unit 11 also includes an expansion valve 17 that may be responsive to, or in part controlled by, a downstream pressure of the evaporation unit 11, sensed at location 19. The expansion valve 17 is configured to control the discharge of refrigerant into the evaporation unit 11, wherein due to the evaporation, heat is absorbed to evaporate the refrigerant to a gaseous state thereby creating a cooling/refrigeration effect at the evaporation unit 11. The evaporation unit 11 returns the expanded refrigerant in a gaseous state along the inlet flow line 3 to the bank of N compressors 6.

It should be noted that, for the sake of convenience, embodiments of the invention are frequently described hereinbelow with respect to their application in systems having multiple scroll compressors for compressing refrigerant. While particular advantages and configurations are shown for scroll compressor, some of these embodiments are not limited to scroll compressors, but may find use in a variety of compressors other than scroll compressors.

Figure 2:
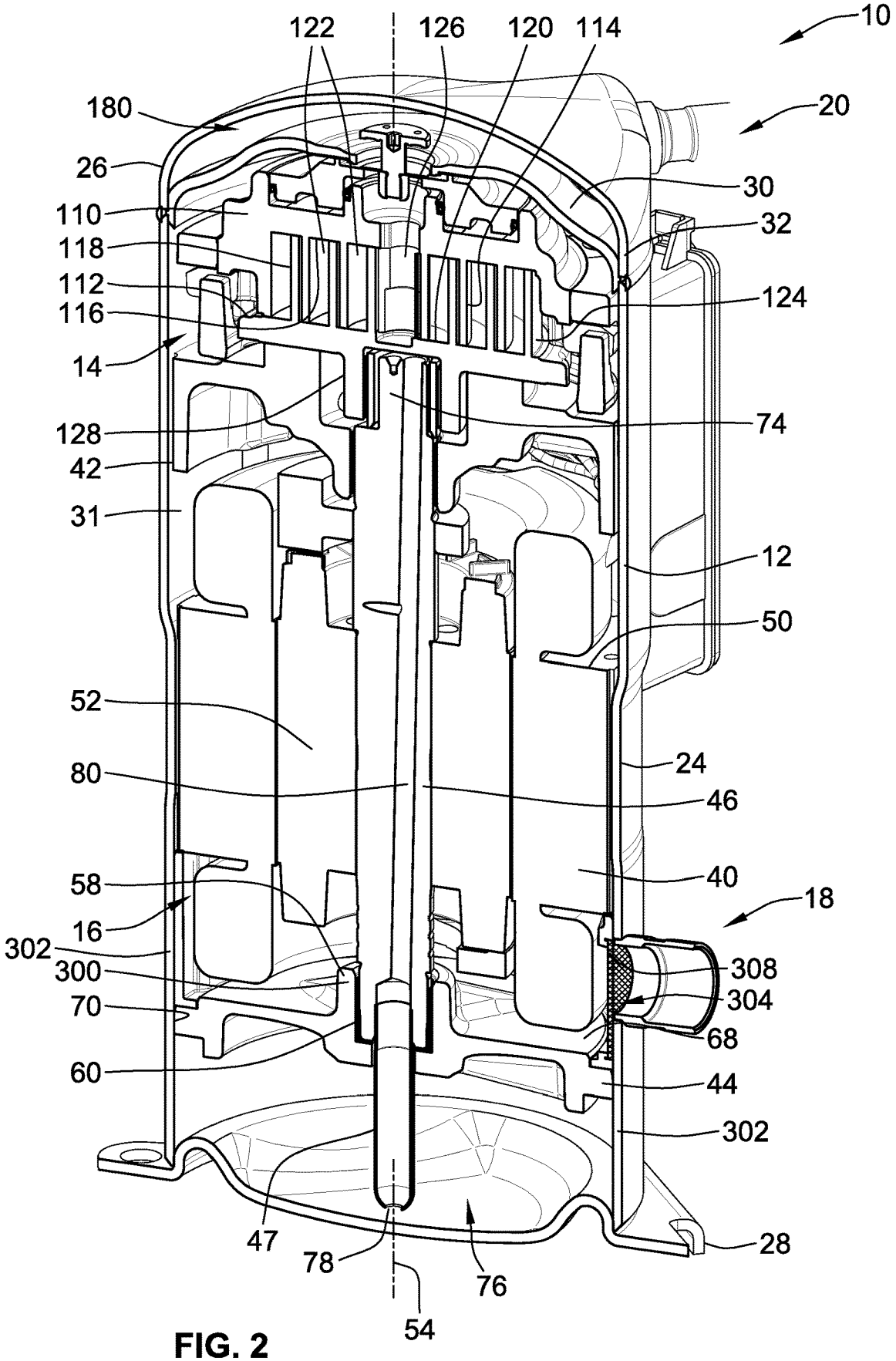
FIG. 2 is a cross-sectional view of a scroll compressor, constructed in accordance with an embodiment of the invention.

An embodiment of the present invention is illustrated in FIG. 2, which illustrates a cross-sectional view of a compressor assembly 10 generally including an outer housing 12 in which a compressor apparatus 14 can be driven by a drive unit 16. In the exemplary embodiments described below, the compressor apparatus 14 is a scroll compressor. Thus, the terms compressor apparatus and scroll compressor are, at times, used interchangeably herein. The compressor assembly 10 may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The compressor assembly 10 is operable through operation of the drive unit 16 to operate the compressor apparatus 14 and thereby compress an appropriate refrigerant or other fluid that enters the refrigerant inlet port 18 and exits the refrigerant outlet port 20 in a compressed high pressure state.

The outer housing 12 may take various forms. In a particular embodiment, the outer housing 12 includes multiple housing or shell sections, and, in certain embodiments, the outer housing 12 has three shell sections that include a central housing section 24, a top end housing section 26 and a bottom end housing section, or base plate 28. In particular embodiments, the housing sections 24, 26, 28 are formed of appropriate sheet steel and welded together to make a permanent outer housing 12 enclosure. However, if disassembly of the outer housing 12 is desired, methods for attaching the housing sections 24, 26, 28 other than welding may be employed including, but not limited to, brazing, use of threaded fasteners or other suitable mechanical means for attaching sections of the outer housing 12.

The central housing section 24 is preferably tubular or cylindrical and may abut or telescopically fit with the top and bottom end housing sections 26, 28. As can be seen in the embodiments of FIG. 2, a separator plate 30 is disposed in the top end housing section 26. During assembly, these components can be assembled such that when the top end housing section 26 is joined to the central cylindrical housing section 24, a single weld around the circumference of the outer housing 12 joins the top end housing section 26, the separator plate 30, and the central cylindrical housing section 24. While the top end housing section 26 is generally dome-shaped and includes a cylindrical side wall region 32 to mate with the center housing section 24 and provide for closing off the top end of the outer housing 12, in particular embodiments, the bottom end housing section may be dome-shaped, cup-shaped, or substantially flat. As shown in FIG. 2, assembly of the outer housing 12 results in the formation of an enclosed chamber 31 that surrounds the drive unit 16, and partially surrounds the compressor apparatus 14.

In an exemplary embodiment of the invention in which a scroll compressor 14 is disposed within the outer housing 12, the scroll compressor 14 includes first and second scroll compressor bodies which preferably include a stationary fixed scroll compressor body 110 and a movable scroll compressor body 112. While the term "fixed" generally means stationary or immovable in the context of this application, more specifically "fixed" refers to the non-orbiting, non-driven scroll member, as it is acknowledged that some limited range of axial, radial, and rotational movement is possible due to thermal expansion and/or design tolerances.

The movable scroll compressor body 112 is arranged for orbital movement relative to the fixed scroll compressor body 110 for the purpose of compressing refrigerant. The fixed scroll compressor body includes a first rib 114 projecting axially from a plate-like base 116 which is typically arranged in the form of a spiral. Similarly, the movable scroll compressor body 112 includes a second scroll rib 118 projecting axially from a plate-like base 120 and is in the shape of a similar spiral. The scroll ribs 114, 118 engage with one another and abut sealingly on the respective surfaces of bases 120, 116 of the respectively other compressor body 112, 110.

In a particular embodiment of the invention, the drive unit 16 in is the form of an electrical motor assembly 40. The electrical motor assembly 40 operably rotates and drives a shaft 46. Further, the electrical motor assembly 40 generally includes a stator 50 comprising electrical coils and a rotor 52 that is coupled to the drive shaft 46 for rotation together. The stator 50 is supported by the outer housing 12, either directly or via an adapter. The stator 50 may be press-fit directly into outer housing 12, or may be fitted with an adapter (not shown) and press-fit into the outer housing 12. In a particular embodiment, the rotor 52 is mounted on the drive shaft 46, which is supported by upper and lower bearing members 42, 44.

Energizing the stator 50 is operative to rotatably drive the rotor 52 and thereby rotate the drive shaft 46 about a central axis 54. Applicant notes that when the terms "axial" and "radial" are used herein to describe features of components or assemblies, they are defined with respect to the central axis 54. Specifically, the term "axial" or "axially-extending" refers to a feature that projects or extends in a direction along, or parallel to, the central axis 54, while the terms "radial" or "radially-extending" indicates a feature that projects or extends in a direction perpendicular to the central axis 54.

In particular embodiments, the lower bearing member 44 includes a central, generally cylindrical hub 58 that includes a central bushing and opening to provide a cylindrical bearing 60 to which the drive shaft 46 is journaled for rotational support. A plate-like ledge region 68 of the lower bearing member 44 projects radially outward from the central hub 58, and serves to separate a lower portion of the stator 50 from an oil lubricant sump 76. An axially-extending perimeter surface 70 of the lower bearing member 44 may engage with the inner diameter surface of the central housing section 24 to centrally locate the lower bearing member 44 and thereby maintain its position relative to the central axis 54. This can be by way of an interference and press-fit support arrangement between the lower bearing member 44 and the outer housing 12.

As can be seen in the embodiment of FIG. 2, the drive shaft 46 includes an impeller tube 47 attached at the bottom end of the drive shaft 46. In a particular embodiment, the impeller tube 47 is of a smaller diameter than the drive shaft 46, and is aligned concentrically with the central axis 54. The drive shaft 46 and impeller tube 47 pass through an opening in the cylindrical hub 58 of the lower bearing member 44. The impeller tube 47 has an oil lubricant passage and inlet port 78 formed at the end of the impeller tube 47.

At its upper end, the drive shaft 46 is journaled for rotation within the upper bearing member 42. Hereinafter, the upper bearing member 42 is also referred to as a "crankcase". In particular embodiments, the drive shaft 46 further includes an offset eccentric drive section 74 which typically has a cylindrical drive surface about an offset axis that is offset relative to the central axis 54. This offset drive section 74 may be journaled within a central hub 128 of the movable scroll compressor body 112 of the scroll compressor 14 to drive the movable scroll compressor body 112 about an orbital path when the drive shaft 46 rotates about the central axis 54. To provide for lubrication of all of the various bearing surfaces, the outer housing 12 provides the oil lubricant sump 76 at the bottom end of the outer housing 12 in which a suitable amount of oil lubricant may be stored.

It can also be seen that FIG. 2 shows an embodiment of a suction duct 300 in use in scroll compressor assembly 10. In certain embodiments, the suction duct 300 comprises a plastic molded ring body 302 that is situated in a flow path through the refrigerant inlet port 18 and in surrounding relation of the motor 40. The suction duct 300 is arranged to direct and guide refrigerant into the motor cavity for cooling the motor 40 while at the same time filtering out contaminants and directing lubricating oil around the periphery of the suction duct 300 to the oil sump 76.

Additionally, in particular embodiments, the suction duct 300 includes a screen 308 in the opening 304 that filters refrigerant gas as it enters the compressor through the inlet port 18, as illustrated in FIG. 2. The screen 308 is typically made of metal wire mesh, such as a stainless steel mesh, in which the individual pore size of the screen 308 typically ranges from 0.5 to 1.5 millimeters.

As shown in FIG. 2 and as mentioned above, the suction duct 300 is positioned in surrounding relation to the motor 40, and, in some embodiments, includes a generally arcuate outer surface that is in surface to surface contact with the inner surface of the generally cylindrical outer housing 12. In particular embodiments, the suction duct 300 includes a sealing face 316 (shown in FIG. 3) that forms a substantial seal between the outer housing 12 and the section duct 300. The sealing face 316 can surround and seal the opening 304 to ensure that refrigerant flows into the motor cavity. The seal may be air tight, but is not required to be. This typically will ensure that more than 90% of refrigerant gas passes through the screen 308 and preferably at least 99% of refrigerant gas. By having a seal between the sealing face 316 and the portion of the housing outer 12 surrounding the inlet port 18, the suction duct 300 can filter large particles from the refrigerant gas that enters through the inlet port 18, thus preventing unfiltered refrigerant gas from penetrating into the compressor, and can direct the cooling refrigerant into the motor cavity for better cooling of the motor 40 while directing a flow of oil down to oil sump 76.

During operation, the refrigerant gas flowing into the inlet port 18 is cooler than compressed refrigerant gas at the outlet port 20. Further, during operation of the scroll compressor 14, the temperature of the motor 40 will rise. Therefore, it is desirable to cool the motor 40 during operation of the compressor. To accomplish this, cool refrigerant gas that is drawn into the compressor outer housing 12 via inlet port 18 flows upward through and along the motor 40 in order to reach the scroll compressor 14, thereby cooling the motor 40.

Furthermore, the impeller tube 47 and inlet port 78 act as an oil pump when the drive shaft 46 is rotated, and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 has various radial passages projecting therefrom to feed oil through centrifugal force to appropriate bearing surfaces and thereby lubricate sliding surfaces as may be required.

Figure 3:
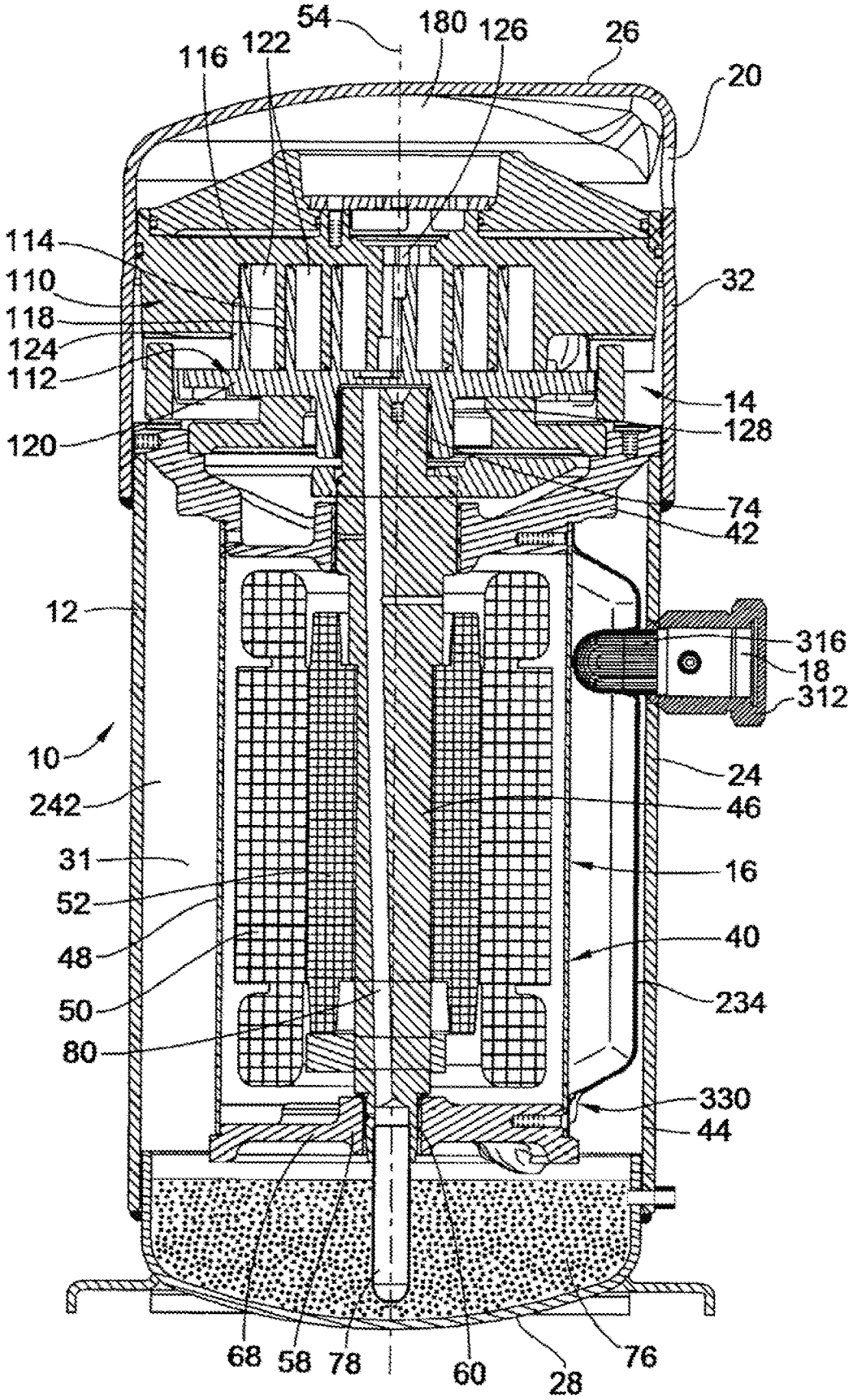
FIG. 3 is a cross-sectional view of a scroll compressor, constructed in accordance with an alternate embodiment of the invention.
Figure 4:
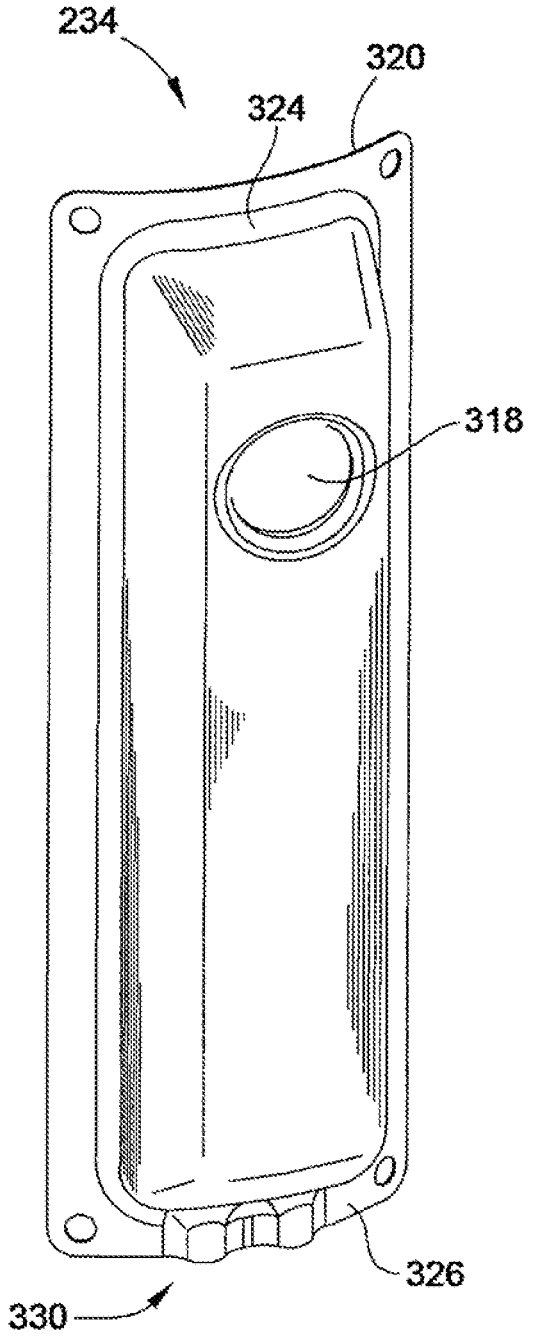
FIG. 4 is a perspective front view of a suction duct, constructed in accordance with an embodiment of the invention.
Figure 5:
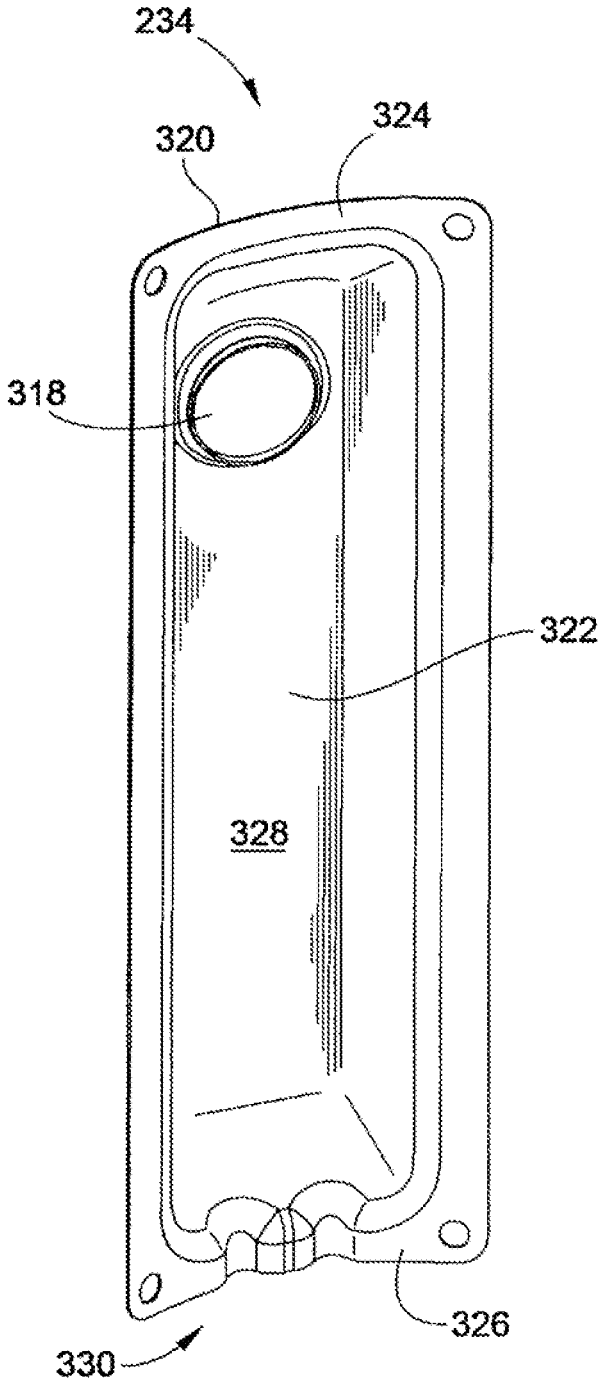
FIG. 5 is a perspective rear view of the suction duct of FIG. 4.

FIG. 3 illustrates a cross-sectional view of an alternate embodiment of a compressor assembly 10. In FIG. 3, it can be seen that a suction duct 234 may be employed to direct incoming fluid flow (e.g. refrigerant) through the housing inlet port 18. To provide for the inlet port 18, the outer housing 12 includes an inlet opening in which resides an inlet fitting 312. In a particular embodiment shown in FIGS. 4 and 5, the suction duct 234 comprises a stamped sheet steel metal body having a constant wall thickness with an outer generally rectangular and arcuate mounting flange 320 which surrounds a duct channel 322 that extends between a top end 324 and a bottom end 326. The entrance opening and port 318 is formed through a channel bottom 328 proximate the top end 324. This opening and port 318 provide means for communicating and receiving fluid from the inlet port 18 via a suction screen flange 316 (shown in FIG. 3) which is received through the outer housing wall of the compressor and into duct channel 322 of the suction duct 234.

A duct channel provides a fluid flow path to a drain port 330 at or near the bottom end 326 of the suction duct 234. In this embodiment, the drain port 330 extends through the bottom end 326 and thereby provides a port for draining lubricant oil into the lubricant oil sump 76, and also to communicate substantially the entire flow of refrigerant for compression to a location just upstream of the motor housing.

Not only does the suction duct 234 direct refrigerant and substantially the entire flow of refrigerant from the inlet port 18 to a location upstream of the motor 40 and to direct fluid flow through the motor 40, but it also acts as a gravitational drain preferably by being at the absolute gravitational bottom of the suction duct 234 or proximate thereto so as to drain lubricant received in the suction duct 234 into the lubricant oil sump 76. This can be advantageous for several reasons. First, when it is desirable to fill the lubricant oil sump 76 either at initial charting or otherwise, oil can readily be added through the inlet port 18, which acts also as an oil fill port so that oil will naturally drain through the suction duct 234 and into the oil sump 76 through the drain port 330. The outer housing 12 can thereby be free of a separate oil port. Additionally, the surfaces of the suction duct 234 and redirection of oil therein causes coalescing of oil lubricant mist, which can then collect within the duct channel 322 and drain through the drain port 330 back into the oil sump 76. Thus, direction of refrigerant as well as direction of lubricant oil is achieved with the suction duct 234.

During operation, the scroll compressor assemblies 10 are operable to receive low pressure refrigerant at the housing inlet port 18 and compress the refrigerant for delivery to a high pressure chamber 180 where it can be output through the housing outlet port 20. As is shown, in FIGS. 2 and 3, the suction duct 234, 300 may be disposed internally of the outer housing 12 to guide the lower pressure refrigerant from the inlet port 18 into outer housing 12 and beneath the motor housing. This allows the low-pressure refrigerant to flow through and across the motor 40, and thereby cool and carry heat away from the motor 40. Low-pressure refrigerant can then pass longitudinally through the motor housing and around through void spaces therein toward the top end of the where it can exit through a plurality of motor housing outlets in the motor housing 48 (shown in FIG. 3), or in the upper bearing member 42. Upon exiting the motor housing outlet, the low-pressure refrigerant enters an annular chamber 242 (shown in FIG. 3) formed between the motor housing 48 and the outer housing 12. From there, the low-pressure refrigerant can pass by or through the upper bearing member 42.

Upon passing through the upper bearing member 42, the low pressure refrigerant finally enters an intake area 124 of the scroll compressor bodies 110, 112. From the intake area 124, the lower pressure refrigerant is progressively compressed through chambers 122 to where it reaches its maximum compressed state at a compression outlet 126 where it subsequently passes through a check valve and into the high pressure chamber 180. From there, high-pressure compressed refrigerant may then pass from the scroll compressor assembly 10 through the outlet port 20.

Figure 6:
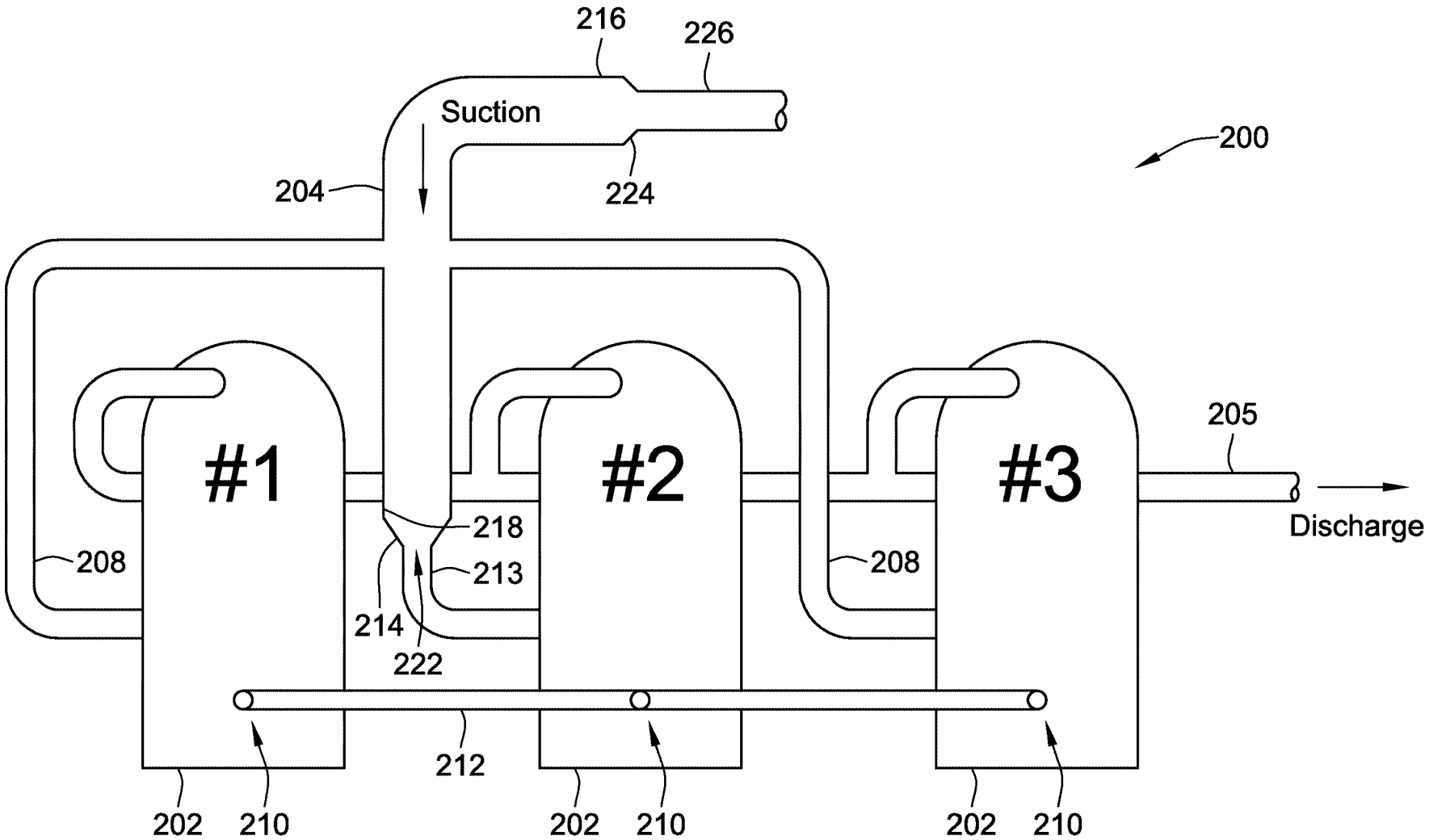
FIG. 6 is a schematic diagram of a multiple-compressor refrigeration system, constructed in accordance with an embodiment of the invention.
Figure 7:
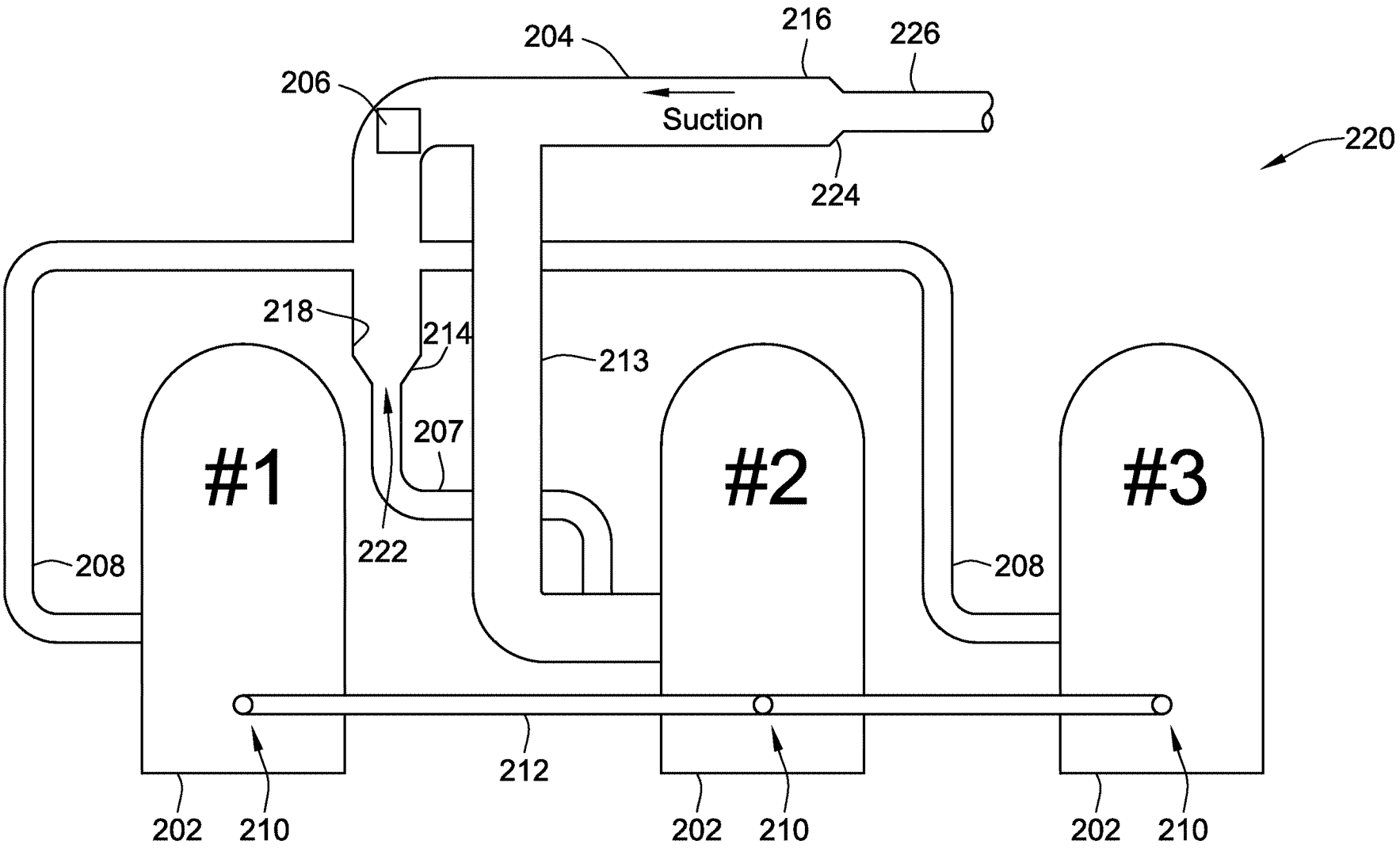
FIG. 7 is a schematic diagram of a multiple-compressor refrigeration system, constructed in accordance with an alternate embodiment of the invention.

FIGS. 6 and 7 are schematic diagrams showing two embodiments of multiple-compressor refrigeration systems 200, 220, such as the one shown in FIG. 1. In the refrigeration system 200 of FIG. 6, compressors #1, #2, and #3 202 are connected in parallel. In a particular embodiment of the invention, the compressors 202 are scroll compressors, similar or identical to those shown in FIGS. 2 and 3. However, in alternate embodiments, compressors other than scroll compressors may be used. Further, the embodiment of FIG. 6 shows the refrigeration system 200 having three compressors 202, though alternate embodiments of the invention may have fewer or greater than three compressors.

With respect to compressors #1, #2, and #3 202, the internal flow of refrigerant through the compressors 202 with their isolated oil sumps 76 configuration creates a pressure drop from the suction inlet port 18 to the oil sump 76 in each of the compressors that are running, due to the restriction of the gas flow. When any of these compressors 202 is shut off and there is no flow restriction, the oil sump 76 pressure will be relatively higher than a running compressor with the same suction inlet pressure. This pressure differential between the oil sump 76 of a running compressor and the oil sump 76 of an off compressor allows for oil distribution from the off compressor to the running compressors in the refrigeration system 200, 220.

Figure 15:
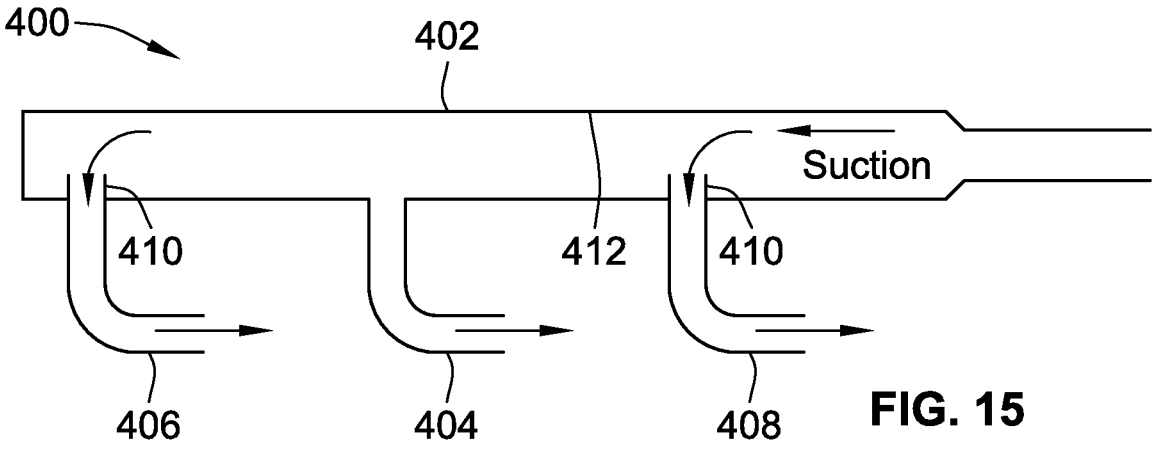

In the arrangements shown in FIGS. 6 and 7, compressor #2 202 is the lead compressor. While all three compressors 202 receive a flow of refrigerant from a suction header 204 and discharge refrigerant to a common discharge or outlet line 205 (shown in FIG. 6 only), the suction header 204 is configured to deliver more lubricating oil to the lead compressor #2 202, via a primary compressor supply conduit 213, than to the non-lead compressors #1 and #3 202, also referred to herein as the remaining compressors #1 and #3 202. In certain embodiments, this is accomplished by restricting secondary compressor supply conduits 208 leading from the suction header 204 to the remaining compressors #1 and #3 202, thereby restricting the flow of oil to these compressors 202. In alternate embodiments, an example of which is illustrated in FIG. 15 and described below, the inner surface of the suction header 204, along which oil flows, is interrupted by the secondary compressor supply conduits 208 protruding into the interior of the suction header 204.

However, as shown in FIG. 7, this may also be accomplished by providing an oil separator 206, which separates out oil from the flow of refrigerant and delivers most of the oil to the lead compressor #2 202 via an oil drain 207. Still, other methods of returning more oil to the lead compressor #2 202 may be used, including different piping configurations, and various types of oil separator devices that return oil directly to the oil sump 76 of the lead compressor #2 202. As referenced above, the suction piping may include a restriction which serves to create a slightly reduced pressure at the suction inlet 18 (shown in FIG. 2) of compressors #1 and #3 202.

As shown in FIGS. 6 and 7, the suction header 204 includes an inlet 216 at one end, and a distal portion 218 at the other end. The distal portion 218 of the suction header 204 is coupled, via a first funnel segment 214, to an inlet port 222 of the primary compressor supply conduit 213 of FIG. 6, or to an inlet port 223 of the oil drain 207 of FIG. 7. The inlet 216 of suction header 204 is coupled, via a second funnel segment 224, to a return conduit 226. In certain embodiments, the second funnel segment 224 provides an increase in cross-sectional flow area as refrigerant flows from the return conduit 226 into the suction header 204. The increase in cross-sectional flow reduces the velocity of the refrigerant flow thereby reducing splashing of oil in the suction header 204.

Figure 8:
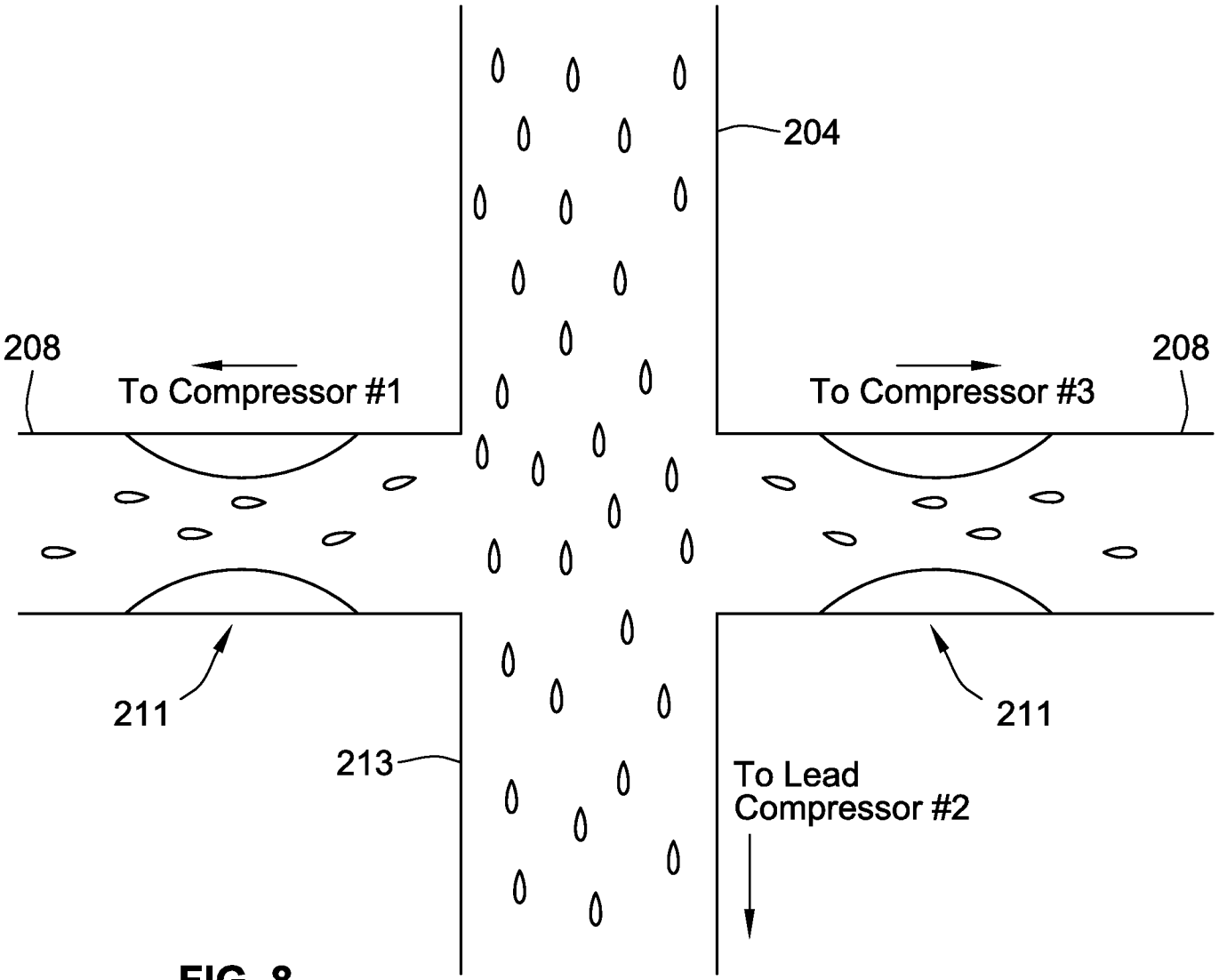
FIG. 8 is a schematic diagram of the suction header, according to an embodiment of the invention
Figure 9:
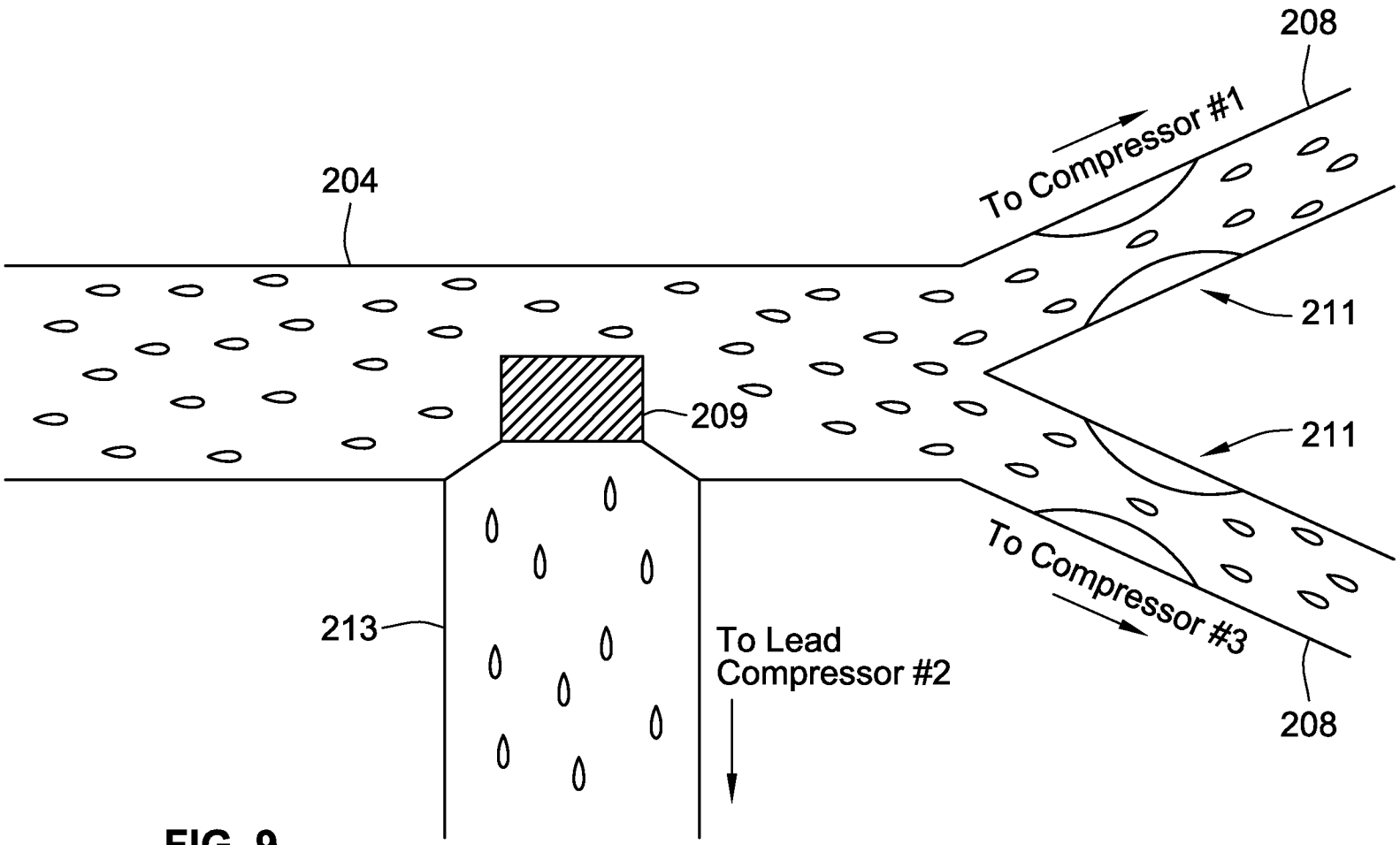
FIG. 9 is a schematic diagram of a suction header with an oil separator, according to an embodiment of the invention.

FIGS. 8 and 9 are schematic diagrams illustrating exemplary piping configurations. As can be seen in FIG. 8, the primary compressor supply conduit 213 leading to the lead compressor #2 202 is larger than the secondary compressor supply conduits 208 that lead to the remaining, non-lead compressors #1, #3 202. Further, the primary compressor supply conduit 213 leading to the lead compressor #2 202 is aligned with the suction header 204, whereas the secondary compressor supply conduits 208 to the remaining, non-lead compressors #1, #3 202 are angled at approximately 90 degrees to the suction header 204, and, in some cases, may protrude inward. This configuration will result in more of the oil circulating within the system flowing to the lead compressor #2 202. Moreover, the flow of oil to the remaining, non-lead compressors #1, #3 202 is further reduced by restrictions 211 placed in the secondary compressor supply conduits 208 to the remaining, non-lead compressors #1, #3 202. These restrictions 211 serve to reduce the suction pressure at the inlets of the remaining compressors #1, #3 202.

FIG. 9 illustrates a different piping configuration than shown in FIG. 8. In this embodiment, an oil separator 209 is disposed in the suction header 204. The oil separator 209 may include a steel mesh to coalesce the oil entrained in the refrigerant flow. Alternately, a fibrous filter media may be used to separate oil from the flow of refrigerant. Other embodiments of the invention include those with centrifugal-type separators. As shown in FIG. 9, once the oil has been extracted from the refrigerant by the oil separator 209, the oil is directed to the primary compressor supply conduit 213 for the lead compressor #2 202. FIG. 9 illustrates that gravity may be used to facilitate the flow of oil to the lead compressor #2 202. As can be seen from FIG. 9, a relatively lesser amount of oil flows around the oil separator 209 to the secondary compressor supply conduits 208 leading to the remaining, non-lead compressors #1, #3 202. As shown, the secondary compressor supply conduits 208, to the remaining non-lead compressors #1, #3 202, include restrictions 211 for reducing the suction pressure at the inlets of the remaining compressors #1, #3 202.

Referring again to FIGS. 6 and 7, each compressor 202 has an opening 210 through its outer housing 12 (see FIGS. 2 and 3) to the oil sump 76 (see FIGS. 2 and 3) for the compressor 202. A pipe 212 is connected to each opening 210 such that all of the oil sumps 76 for compressors #1, #2, and #3 202 are in fluid communication via pipe 212. In a particular embodiment of the invention, each opening 210 is located at approximately the same position on the outer housings 12 of the compressors 202. Each opening 210 may be located at the same horizontal level, or located at a particular sump level such that the position of each opening 210 represents a minimum level of oil that should be retained in the oil sump 76 before that compressor 202 can distribute its oil to other compressors 202. Locating the openings 210 in this manner allows for oil to flow through the pipe 212 from the lead compressor #2 202 to other operating compressors 202 in need of oil. In the embodiments shown in FIGS. 6 and 7, the suction header 204 is configured to return more oil from the flow of refrigerant to the lead compressor #2 202. When the oil level in the oil sump 76 of the lead compressor #2 202 rises above the level of the opening 210 and above the level in compressors #1 and #3 202 (assuming these compressors are running), the oil sump pressure in the lead compressor #2 202 tends to be higher than that of compressors #1 and #3 202, thus allowing oil to flow through pipe 212 from the lead compressor #2 202 to the remaining compressors #1 and #3 202.

This flow can take place whether or not the lead compressor #2 202 is running, as long as the oil sump pressure in the lead compressor #2 202 is higher than the oil sump pressure in the receiving compressor 202. In certain embodiments, the oil will continue to be distributed in this manner until the oil sump pressures in the lead compressor #2 202 and the receiving compressor(s) 202 are approximately equal. However, when either or both of the remaining compressors #1 and #3 202 is not running, the increased oil sump pressure in the non-running or non-operating compressor 202 prevents oil from the lead compressor #2 202 from flowing to the non-running compressor 202.

The combination of providing more oil to the lead compressor #2 202 and configuring the piping to create reduced pressure at the suction inlet port 18 in the remaining compressors #1 and #3 202 will result in sufficient oil distribution to all of the compressors #1, #2, and #3 202 in this multiple-compressor arrangement, regardless of whether any individual compressor is on or off. This is shown in the operating matrix below in Table 1.

TABLE 1

| I = ON; O = OFF | | | | | |
|---|---|---|---|---|---|
| Comp #1 | Sump ΔP | Comp #2 | Sump ΔP | Comp #3 | Description (Running Compressors need oil) |
| I | < | I | > | I | #2 receives system oil and feeds #1 & #3 |
| O | > | I | > | I | #2 receives system oil and feeds #3 |
| 1 | < | O | > | I | #2 receives system oil and feeds #1 & #3 |
| 1 | < | I | < | O | #2 receives system oil and feeds #1 |
| O | > | O | > | I | #2 receives system oil and feeds #3 |
| I | < | O | < | O | #2 receives system oil and feeds #1 |
| O | > | I | < | O | #2 receives system oil |

The above-shown matrix (Table 1) indicates how oil is distributed in the refrigeration systems of FIGS. 6 and 7 when the running compressor(s) need oil. As can be seen from the matrix above, when all of the compressors #1, #2, and #3 202 are running, or if the lead compressor #2 202 is off and the remaining compressors #1 and #3 202 are running, the lead compressor #2 202 distributes lubricating oil as needed to the remaining compressors #1 and #3 202. In the case where either, compressor #1 202 is off, or compressor #1 202 and the lead compressor #2 202 are both off, the lead compressor #2 202 provides lubricating oil to the remaining compressor #3 202. Conversely, when compressor #3 202 is off, or when compressor #3 202 and the lead compressor #2 202 are both off, the lead compressor #2 202 provides lubricating oil to the remaining compressor #1 202. Finally, when the lead compressor #2 202 is running, and both remaining compressors #1 and #3 202 are off, the lead compressor #2 202 does not provide any lubricating oil to the remaining compressors #1 and #3 202.

FIGS. 10-13 and 15 are schematic cross-sectional views of various embodiments of suction piping arrangements 400, wherein each such arrangement 400 includes a suction header 402 oriented in a substantially horizontal position, as opposed to the vertical orientations shown in FIGS. 6 and 7. However, in alternate embodiments of the invention, the suction header 402 may be slightly pitched from horizontal. For example, the suction header 402 could be pitched at an angle between zero and five degrees from horizontal, though larger angles are possible.

As the refrigerant flows through the suction header 402, droplets of the entrained oil collect on the inner walls of the suction header 402. A primary compressor supply conduit 404, which branches off from the suction header 402, carries refrigerant and oil to one of the compressors 202 of the refrigeration system 200, 220 (shown in FIGS. 6 and 7). A secondary compressor supply conduit 406, which also branches off from the suction header 402, carries refrigerant and oil to a different one of the compressors 202 (shown in FIGS. 6 and 7) of the refrigeration system 200, 220 than supplied by a primary compressor supply conduit 404. In an embodiment, the primary compressor supply conduit 404 is configured to supply a greater amount of oil to its lead compressor 202 than the secondary compressor supply conduit 406 supplies to its non-lead compressor 202. As such, it can be seen in FIGS. 10-15 that the inlet port for the primary compressor supply conduit 404, that is, where the primary compressor supply conduit 404 intersects the suction header 402 is lower than the inlet port for the secondary compressor supply conduit 406. In each of FIGS. 10-15, the secondary compressor supply conduit 406 protrudes inward in to the suction header 402 such that oil flowing along the inner surface of the suction header 402 does not flow into the compressor supplied by the secondary compressor supply conduit 406.

In some cases, where both the primary compressor supply conduit 404 and the secondary compressor supply conduit 406 connect along a bottom portion of the suction header 402, the amount of oil supplied by the secondary compressor supply conduit 406 is reduced by having the inlet port for the secondary compressor supply conduit 406 protrude up into the suction header 402 farther than the inlet port for the primary compressor supply conduit 404. In other cases, this may be accomplished by connecting the inlet port for the secondary compressor supply conduit 406 at a bottom portion of the suction header 402, while connecting the inlet port for the secondary compressor supply conduit 406 along a side or top portion of the suction header 402. In the embodiments shown in FIGS. 10-15, a portion of the inlet port for the secondary compressor supply conduit 406 protrudes into the interior of the suction header 402 even when connected along a side or top portion of the suction header 402. In certain embodiments of the invention, the inlet port of the primary compressor supply conduit is vertically below the inlet port of the secondary compressor supply conduit by at least one centimeter.

There are other ways that the primary compressor supply conduit 404 could be configured to supply a greater amount of oil to its lead compressor 202 than the secondary compressor supply conduit 406 supplies to its non-lead compressor 202, in addition to those described above. For example, in a particular embodiment, the primary compressor supply conduit 404 has a larger inner diameter than that of the secondary compressor supply conduit 406. In an alternate embodiment, such as in FIGS. 8 and 9, the secondary compressor supply conduit 406 has a restriction to restrict the flow of refrigerant therethrough so that the flow of refrigerant and oil through the primary compressor supply conduit 404 is greater than the flow through the secondary compressor supply conduit 406. In yet another embodiment, the primary compressor supply conduit 404 branches off from the suction header 402 in a vertically downward direction, as shown in FIGS. 10-15, allowing gravity to assist the flow of refrigerant and oil through the primary compressor supply conduit 404. In the embodiments of FIGS. 11 and 12, the secondary compressor supply conduit 406 branches off from the suction header 402 in a vertically upward direction, respectively, ensuring that the flow of oil through the secondary compressor supply conduit 406 is less than the flow through the primary compressor supply conduit 404.

Figure 10:
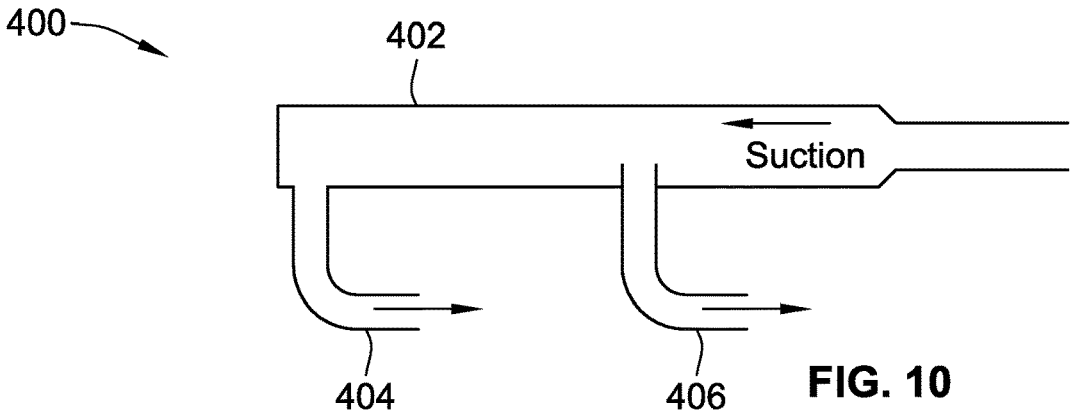
FIGS. 10-15 are schematic diagrams illustrating various suction flow piping arrangements, according to embodiments of the invention.
Figure 11:
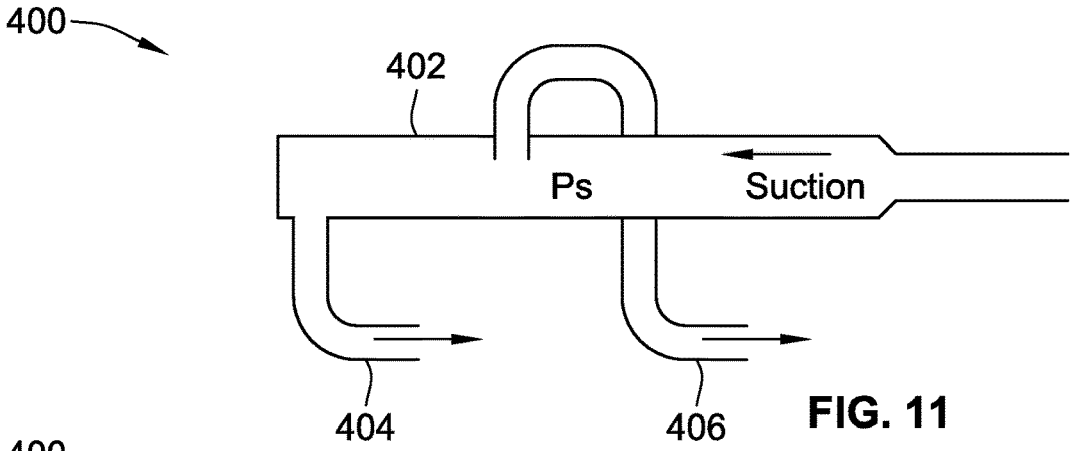
Figure 12:
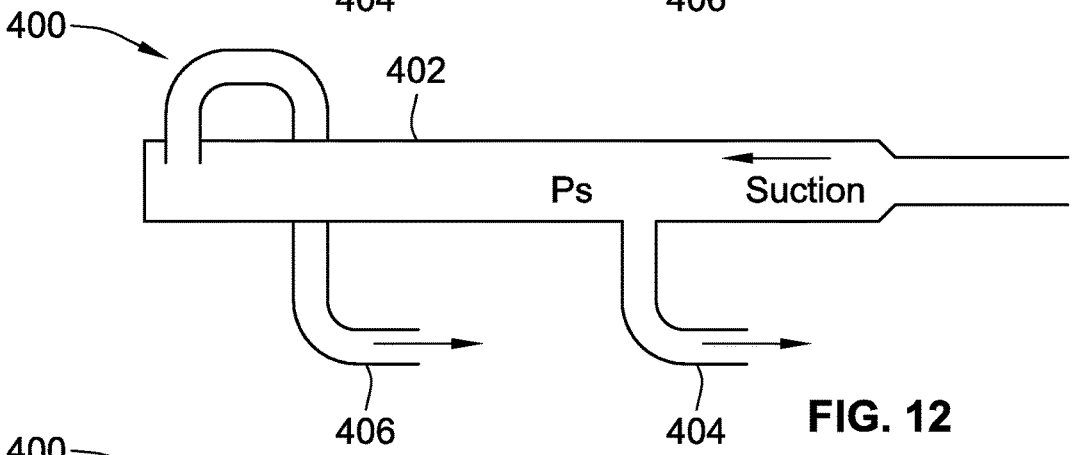
Figure 13:
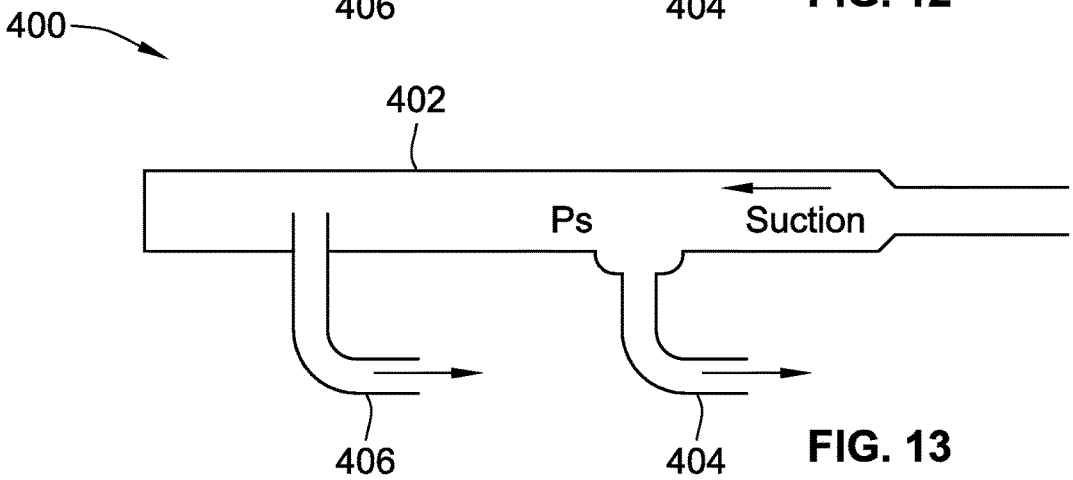

In the embodiments of FIGS. 10 and 11, the secondary compressor supply conduit 406 is positioned upstream of the primary compressor supply conduit 404 such that the flow of refrigerant and oil reaches the secondary compressor supply conduit 406 before it reaches the primary compressor supply conduit 404. In the embodiments of FIGS. 12 and 13, the secondary compressor supply conduit 406 is positioned downstream of the primary compressor supply conduit 404 such that the flow of refrigerant and oil reaches the secondary compressor supply conduit 406 before it reaches the primary compressor supply conduit 404. Additionally, the embodiment of FIG. 13 includes a primary compressor supply conduit 404 with a widened inlet port to allow oil to more easily flow into the primary compressor supply conduit 404.

Figure 14:
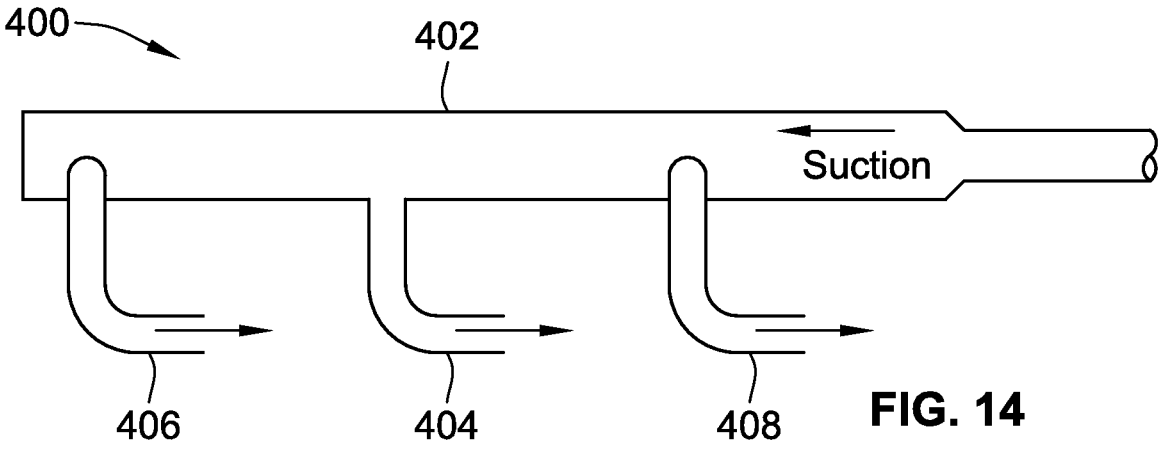

FIG. 14 is a schematic plan view of suction piping arrangement 400 with suction header 402, primary compressor supply conduit 404, a secondary compressor supply conduit 406 downstream of the primary compressor supply conduit 404, and a tertiary compressor supply conduit 408 upstream of the primary compressor supply conduit 404. In the embodiment shown, secondary and tertiary compressor supply conduits 406, 408 branch out horizontally, or substantially horizontally from the suction header 402, but these lines could also be arranged to branch out in a vertically upward direction from the suction header 402. Furthermore, in certain embodiments of the invention, secondary and tertiary compressor supply conduits 406, 408 are pitched at a slight angle from horizontal. Additionally, in particular embodiments, the inlet ports of the secondary and tertiary compressor supply conduits 406, 408 protrude into the interior of the suction header 402 such that oil flowing along the inner wall of the suction header 402 will bypass the secondary and tertiary compressor supply conduits 406, 408.

FIG. 15 is a schematic cross-sectional view of suction piping arrangement 400 with suction header 402, primary compressor supply conduit 404, secondary compressor supply conduit 406 downstream of the primary compressor supply conduit 404, and tertiary compressor supply conduit 408 upstream of the primary compressor supply conduit 404. However, in this embodiment, each of the primary, secondary, and tertiary compressor supply conduits 404, 406, 408 descend vertically from the suction header 402. However, as can be seen in FIGS. 10-13, the secondary and tertiary compressor supply conduits 406, 408 have an extension segment 410 (i.e. the portion of the inlet port that protrudes into the interior of the suction header 402) that passes through an annular wall 412 of the suction header 402. The secondary compressor supply conduit 406 protrudes inward in to the suction header 402 such that oil flowing along the inner surface of the suction header 402 does not flow into the compressor supplied by the secondary compressor supply conduit 406. The extension segment 410 ensures that some of the oil flowing in the suction header bypasses the secondary and tertiary compressor supply conduits 406, 408. Most of the oil will flow into the primary compressor supply conduit 404 which, in certain embodiments such as FIG. 15, form a gravitational drain at a vertical bottom location of the suction header 404. In a particular embodiment, the secondary compressor supply conduit 406 protrudes into the suction header 402 a distance equaling from 25% to 75% of the suction header inner diameter.

FIG. 16 is a cross-sectional view of the suction header 402 and secondary compressor supply conduit 406. An arc of intersection is defined by an angle 407 whose vertex is a longitudinal axis 409 of the suction header 402. The arc of intersection is the portion of the suction header annular wall 412 that is intersected by the secondary compressor supply conduit 406, which may or may not protrude into the interior of the suction header 402. In FIG. 16, this intersection takes place on an upper portion of the suction header annular wall 412. In alternate embodiments, this intersection takes place on a side portion of the suction header annular wall 412. In operation, a majority of the oil droplets flowing through the suction header 402 will bypass the secondary compressor supply conduit 406 due to its intersection on the side or upper portion of the suction header annular wall 412, whereas most of the oil will flow into the primary compressor supply conduit 404 located at or near a gravitational bottom of the suction header annular wall 412.

Another embodiment of the invention is shown in FIG. 17, which is a cross-sectional view of a refrigeration system that employs a vertical header within the housing of the lead compressor 202. Two compressors 202 are shown in FIG. 17, though the arrangement shown can be used in a refrigeration system having more than two compressors 202. In the embodiment of FIG. 17, the flow of refrigerant and oil is supplied only to the lead compressor 202, from which the refrigerant is distributed to the other compressors 202 in the system. Refrigerant and oil flows into a port 303 in an upper portion of the compressor housing and into a vertical header 301, which leads down into the oil lubricant sump 76. The oil is separated from the refrigerant in the vertical header 301. The separated oil drains into the oil lubricant sump 76. The refrigerant flows down the vertical header 301 and some of the refrigerant flows into the compression apparatus of the lead compressor 202, while the remaining refrigerant flows out of a second port 305 in a lower portion of the compressor housing to the remaining compressors 202 in the system via piping 306.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A refrigeration system comprising:

two or more compressors configured to compress a flow of refrigerant, the flow of refrigerant having oil entrained therein;

a suction flow piping arrangement configured to supply a flow of refrigerant and oil to the two or more compressors, the suction flow piping arrangement comprising:

a suction header configured to carry the flow of refrigerant and oil, wherein the suction header is disposed either horizontally or at an angle between zero and five degrees from horizontal;

a primary compressor supply conduit connected to, and branching off from, the suction header, the primary compressor supply conduit configured to supply refrigerant and oil to a first compressor of the two or more compressors;

a secondary compressor supply conduit branching off from the suction header, the secondary compressor supply conduit configured to supply refrigerant to a second compressor of the two or more compressors;

wherein the primary compressor supply conduit is configured to supply more oil to the first compressor than the secondary compressor supply conduit supplies to the second compressor.

2. The refrigeration system of claim 1, wherein the primary compressor supply conduit has an inlet port connected to the suction header and the secondary compressor supply conduit has an inlet port connected to the header, wherein the inlet port of the primary compressor supply conduit is vertically below the inlet port of the secondary compressor supply conduit.

3. The refrigeration system of claim 2, wherein the inlet port of the primary compressor supply conduit forms a gravitational drain as an opening at a vertical bottom location of the suction header.

4. The refrigeration system of claim 3, wherein the suction header further comprises a funnel portion that reduces a diameter of the suction header, and connects a larger-diameter area of the suction header with a smaller diameter area of the inlet port for the primary compressor supply conduit.

5. The refrigeration system of claim 3, wherein the suction flow piping arrangement includes a return conduit upstream of the suction header and connected to an inlet of the suction header, the suction header having a distal end farthest away from the inlet, the inlet port of the primary compressor supply conduit being disposed closer to the distal end than the inlet port of the secondary compressor supply conduit.

6. The refrigeration system of claim 2, wherein the suction header comprises an annular wall having a circumference of 360 degrees surrounding a central passage, wherein the secondary compressor supply conduit intersects the annular wall at a side or upper portion of the annular wall such that an arc of the intersection is less than 120 degrees, wherein, during operation, oil flows along an internal surface of the annular wall, and a majority of oil bypasses the inlet port of the secondary compressor supply conduit.

7. The refrigeration system of claim 6, wherein the arc of the intersection ranges from 60 to 100 degrees.

8. The refrigeration system of claim 2, wherein the suction header comprises an annular wall surrounding a central passage, wherein the secondary compressor supply conduit intersects the annular wall and extends internally past the annular wall into the central passage via an extension segment, wherein, during operation, oil flows along an internal surface of the annular wall, and a majority of oil bypasses the inlet port of the secondary compressor supply conduit.

9. The refrigeration system of claim 8, wherein the extension segment protrudes into the suction header a distance equal to between 25% and 75% of an inner diameter of the suction header.

10. The refrigeration system of claim 2, wherein the inlet port of the primary compressor supply conduit is vertically below the inlet port of the secondary compressor supply conduit by at least one centimeter.

11. The refrigeration system of claim 1, wherein the primary compressor supply conduit defines a first flow area and a flow path thereof, and the secondary compressor supply conduit defines a second flow area and a flow path thereof, the first flow path creating a pressure drop to a first compressor oil sump and the second flow path creating a pressure drop to a second compressor oil sump such that a pressure in the first compressor oil sump is from 0.1 psi to 2.0 psi greater than the pressure in the second compressor oil sump.

12. The refrigeration system of claim 1, wherein the primary compressor supply conduit defines a first minimum flow area along a flow path thereof and the secondary compressor supply conduit defines a second minimum flow area along a flow path thereof, and wherein the suction header comprises a minimum flow area that is at least 1.5 times as large as the first and second minimum flow areas combined.

13. The refrigeration system of claim 12, wherein the suction flow piping arrangement includes a return conduit upstream of the suction header and connected to an inlet of the suction header, the return conduit having a minimum flow area, the minimum flow area of the suction header being at least 1.4 times larger than the minimum flow area of the return conduit, wherein the suction header has a decreased flow velocity during operation for reduced splashing of oil carried along the inner wall of the return conduit upon entry into the suction header.

14. The refrigeration system of claim 12, further comprising an expansion funnel segment that expands the cross-sectional flow area as refrigerant flows from the return conduit into the suction header.

15. The refrigeration system of claim 1, wherein the primary and secondary compressor supply conduits each have inner diameters between 25% and 75% of an inner diameter of the suction header.

16. The refrigeration system of claim 15, wherein the primary and secondary compressor supply conduits each have inner diameters between 45% and 55% of an inner diameter of the suction header.

17. The refrigeration system of claim 1, wherein an inner diameter of the primary compressor supply conduit is greater than an inner diameter of the secondary compressor supply conduit.

18. The refrigeration system of claim 1, wherein the secondary compressor supply conduit is configured to restrict a flow there through such that the flow through the secondary compressor supply conduit is less than the flow through the primary compressor supply conduit.

19. The refrigeration system of claim 1, wherein the primary compressor supply conduit branches off from the suction header in a vertically downward direction, and the secondary compressor supply conduit branches off from the suction header in a vertically upward direction.

20. The refrigeration system of claim 1, wherein the primary compressor supply conduit branches off from the suction header in a vertically downward direction, and the secondary compressor supply conduit branches off from the suction header in a substantially horizontal direction.

21. The refrigeration system of claim 1, wherein a pressure within the primary compressor supply conduit is greater than a pressure within the secondary compressor supply conduit.

22. The refrigeration system of claim 21, wherein the pressure within the primary compressor supply conduit is from 0.3 psi to 2.0 psi greater than the pressure in the secondary compressor supply conduit.

23. The refrigeration system of claim 1, further comprising a tertiary compressor supply conduit connected to the suction header, and configured to supply refrigerant and oil to a third compressor, wherein the primary compressor supply conduit is configured to supply more oil to the first compressor than the tertiary compressor supply conduit supplies to the third compressor.

24. The refrigeration system of claims 23, wherein an oil sump pressure in the second compressor is between zero and 0.4 psi greater than an oil sump pressure in the third compressor, and wherein an oil sump pressure in the first compressor is greater than the oil sump pressure in the second compressor.

25. The refrigeration system of claim 1, wherein the flow of refrigerant and oil through the suction header reaches the primary compressor supply conduit before it reaches the secondary compressor supply conduit.

26. The refrigeration system of claim 1, wherein the flow of refrigerant and oil through the suction header reaches the secondary compressor supply conduit before it reaches the primary compressor supply conduit.

27. The refrigeration system of claim 1, wherein each of the two or more compressors include an opening in its compressor housing, each opening located proximate an oil sump of its respective compressor, the openings being connected via an oil sump connection, and wherein, during operation, a differential pressure exists with a higher pressure in the primary compressor to cause distribution of excess oil returned to the primary compressor to the secondary compressor through the oil sump connection.

28. A method of distributing oil in a multiple-compressor system, the method comprising the steps of:

returning a flow of oil and refrigerant to a suction header, the suction header being disposed either horizontally or at an angle between zero and five degrees from horizontal;

directing a flow of oil from the suction header to two or more compressors, wherein a majority of the oil is directed to a lead compressor; and distributing oil from the lead compressor to one or more non-lead compressors coupled in parallel with the lead compressor;

wherein directing a flow of oil from the suction header to two or more compressors comprises directing oil to the lead compressor via a primary compressor supply conduit, and directing oil to the one or more non-lead compressors via a secondary compressor supply conduit, wherein the flow pressure in the primary compressor supply conduit is greater than the flow pressure in the secondary compressor supply conduit;

wherein directing oil to the lead compressor via a primary compressor supply conduit comprises directing oil to the lead compressor via the primary compressor supply conduit having an inlet positioned to form a gravitational drain at a vertical bottom location of the suction header.

29. The method of claim 28, wherein the secondary compressor supply conduit includes a flow restriction means to reduce the flow pressure therethrough.

30. The method of claim 28, wherein the secondary compressor supply conduit protrudes into the interior of the suction header via an extension segment.

31. The method of claim 30, wherein the extension segment protrudes into the suction header a distance equal to between 25% and 75% of an inner diameter of the suction header.

32. The method of claim 28, wherein the primary compressor supply conduit branches off from the suction header in one of a downwardly vertical, downwardly angled, or horizontal direction.

33. The method of claim 28, wherein directing oil to the one or more non-lead compressors via a secondary compressor supply conduit comprises directing oil to the one or more non-lead compressors via a secondary compressor supply conduit having an inlet positioned at a higher elevation than the inlet of the primary compressor supply conduit.

34. The method of claim 33, wherein the secondary compressor supply conduit branches off from the suction header in either a horizontal, upwardly vertical, or upwardly angled direction.

* * * * *